US010218105B2

(12) United States Patent
Stange et al.

(10) Patent No.: US 10,218,105 B2
(45) Date of Patent: Feb. 26, 2019

(54) ARRANGEMENT FOR ESTABLISHING AN ELECTRICAL CONNECTION BETWEEN A TAB CONTACT AND A HIGH CURRENT CONDUCTOR

(71) Applicant: TE Connectivity Germany GmbH, Bensheim (DE)

(72) Inventors: Holger Stange, Frankenthal (DE); Ruediger Meier, Neckargemund (DE)

(73) Assignee: TE Connectivity Germany GmbH, Bensheim (DE)

( * ) Notice: Subject to any disclaimer, the term of this patent is extended or adjusted under 35 U.S.C. 154(b) by 72 days.

(21) Appl. No.: 15/253,282

(22) Filed: Aug. 31, 2016

(65) Prior Publication Data

US 2017/0062966 A1 Mar. 2, 2017

(30) Foreign Application Priority Data

Aug. 31, 2015 (DE) ..... 10 2015 216 632

(51) Int. Cl.

| | |
|---|---|
| ***H01R 13/18*** | (2006.01) |
| ***H01R 13/187*** | (2006.01) |
| ***H01R 13/11*** | (2006.01) |
| ***H01R 4/26*** | (2006.01) |
| ***H01R 4/48*** | (2006.01) |
| ***H01R 4/58*** | (2006.01) |
| ***H01R 13/22*** | (2006.01) |
| ***H01R 13/50*** | (2006.01) |
| ***H01R 13/627*** | (2006.01) |

(52) U.S. Cl.

CPC ..... *H01R 13/187* (2013.01); *H01R 4/26* (2013.01); *H01R 4/4809* (2013.01); *H01R 4/58* (2013.01); *H01R 13/113* (2013.01); *H01R 13/22* (2013.01); *H01R 13/50* (2013.01); *H01R 13/6275* (2013.01)

(58) Field of Classification Search

CPC ..... H01R 13/187

See application file for complete search history.

(56) References Cited

U.S. PATENT DOCUMENTS

| | | | | |
|---|---|---|---|---|
| 2,997,685 A | | 8/1961 | Anderson | |
| 3,453,587 A | * | 7/1969 | Neidecker ..... | H01R 13/187 439/723 |

(Continued)

FOREIGN PATENT DOCUMENTS

| | | |
|---|---|---|
| CH | 702863 A1 | 3/2010 |
| DE | 1665132 | 1/1971 |

(Continued)

OTHER PUBLICATIONS

German Office Action, dated May 27, 2016, 6 pages.
Abstract of DE3330984, dated Mar. 14, 1985, 1 page.
Abstract of DE102005043601, dated Mar. 22, 2007, 1 page.

*Primary Examiner* — James Harvey
(74) *Attorney, Agent, or Firm* — Barley Snyder

(57) ABSTRACT

A holding structure for an arrangement establishing an electrical connection between a tab contact and a high current conductor is disclosed. The holding structure includes a connection section with at least one mounting arm for mounting to a contacting section of a high current conductor, a receptacle for a tab contact, and at least one press-on element configured to generate a contact pressure in the direction of the connection section.

20 Claims, 3 Drawing Sheets

(56) References Cited

U.S. PATENT DOCUMENTS

| | | | | |
|---|---|---|---|---|
| 5,588,884 | A * | 12/1996 | Rudoy | H01R 13/187 439/787 |
| 6,452,101 | B1 | 9/2002 | Haramaki et al. | |
| 7,789,720 | B2 | 9/2010 | Zinn | |
| 7,845,993 | B2 * | 12/2010 | Falchetti | H01R 13/18 439/843 |
| 8,668,531 | B2 * | 3/2014 | Yamaguchi | H01R 13/187 439/843 |
| 8,821,170 | B1 * | 9/2014 | Thein | H01R 4/4881 439/121 |
| 9,231,326 | B2 | 1/2016 | Goesmann et al. | |
| 9,716,332 | B1 * | 7/2017 | Wimmer | H01R 13/03 |
| 9,893,450 | B2 * | 2/2018 | Koyama | H01R 13/187 |
| 2001/0019923 | A1 * | 9/2001 | Moll | H01R 13/187 439/816 |
| 2002/0025732 | A1 * | 2/2002 | Hsieh | H01R 13/187 439/845 |
| 2004/0014370 | A1 * | 1/2004 | Zhao | H01R 11/22 439/843 |
| 2007/0066152 | A1 * | 3/2007 | Mohs | H01R 13/113 439/843 |
| 2008/0271921 | A1 * | 11/2008 | Hengel | H01R 4/4881 174/88 B |
| 2011/0045712 | A1 * | 2/2011 | Mukuno | H01R 4/4881 439/845 |
| 2017/0062966 | A1 * | 3/2017 | Stange | H01R 13/113 |

FOREIGN PATENT DOCUMENTS

| | | |
|---|---|---|
| DE | 33 30 984 A1 | 3/1985 |
| DE | 10 2005 043 601 B4 | 3/2007 |

* cited by examiner

ARRANGEMENT FOR ESTABLISHING AN ELECTRICAL CONNECTION BETWEEN A TAB CONTACT AND A HIGH CURRENT CONDUCTOR

CROSS-REFERENCE TO RELATED APPLICATIONS

This application claims the benefit of the filing date under 35 U.S.C. § 119(a)-(d) of German Patent Application No. 102015216632.5, filed Aug. 31, 2015.

FIELD OF THE INVENTION

The invention relates to an electrical connector and more particularly to an arrangement for establishing an electrical connection between a tab contact and a high current conductor.

BACKGROUND

In high current technology, in particular in direct current technology for the automotive industry, it is often necessary to connect a high current conductor, such as, for example, a grounding strap or a bus bar, to a tab contact, for example a cable lug. Specifically, in the automotive industry it is necessary for the connections to be vibration resistant. Since high currents are generally conveyed through the connections, a good electrical contact between the high current conductor and the tab contact is additionally required. Moreover, it is often desirable for this type of connection to be able to be closed and/or released quickly. Arrangements of the aforementioned type are known in the prior art. For example, both the end of the high current conductor to be connected and the tab contact can respectively be provided with an opening through which a screw can be guided so that the tab contact can be screwed to the high current conductor. This method can lead to a good electrical connection, but is complex to manage. Another known type of connection is one where the high current conductor is initially provided securely with a bushing for the tab contact. The tab contact can then be introduced into the bushing. This allows simple connection, but here too it is laborious to establish and the electrical contact is additionally achieved by means of the bushing. High contact resistances may occur here at a number of points.

SUMMARY

It is, therefore, an object of the invention to provide an arrangement of the type specified above that provides a good electrical contact between a high current conductor and a tab contact in order to convey high currents, allow rapid connection and rapid release of the high current conductor and the tab contact, and can be produced quickly and easily.

In accordance with the invention, a holding structure for an arrangement for establishing an electrical connection between a tab contact and a high current conductor, the holding structure includes a connection section with at least one mounting arm for mounting to a contacting section of a high current conductor, a receptacle for a tab contact, and at least one press-on element configured to generate a contact pressure in the direction of the connection section.

The arrangement according to the invention can additionally include a protective housing which surrounds the holding structure according to the invention on a high current conductor according to the invention so that protection against contact is formed for an operator. The protective housing according to the invention can in particular be closed so that a VDE test finger cannot establish any contact with conductive parts in the interior of the protective housing. The protective housing can be closed to such an extent that there is just a single opening for a tab contact which clears the receptacle for the tab contact in the holding structure to the outside.

In the following the invention will be described in more detail by examples using advantageous embodiments with reference to the drawings. The feature combinations illustrated as examples by the embodiments can be supplemented by additional features for a specific application in accordance with what has been stated above. Individual features may also be omitted in the embodiments described, likewise in accordance with what has been stated above, if the effect of this feature is of no consequence in a specific application.

BRIEF DESCRIPTION OF THE DRAWINGS

In the drawings, the same reference signs are always used for elements with the same function and/or the same structure.

These show as follows.

DETAILED DESCRIPTION OF THE EMBODIMENTS

Figure 1:
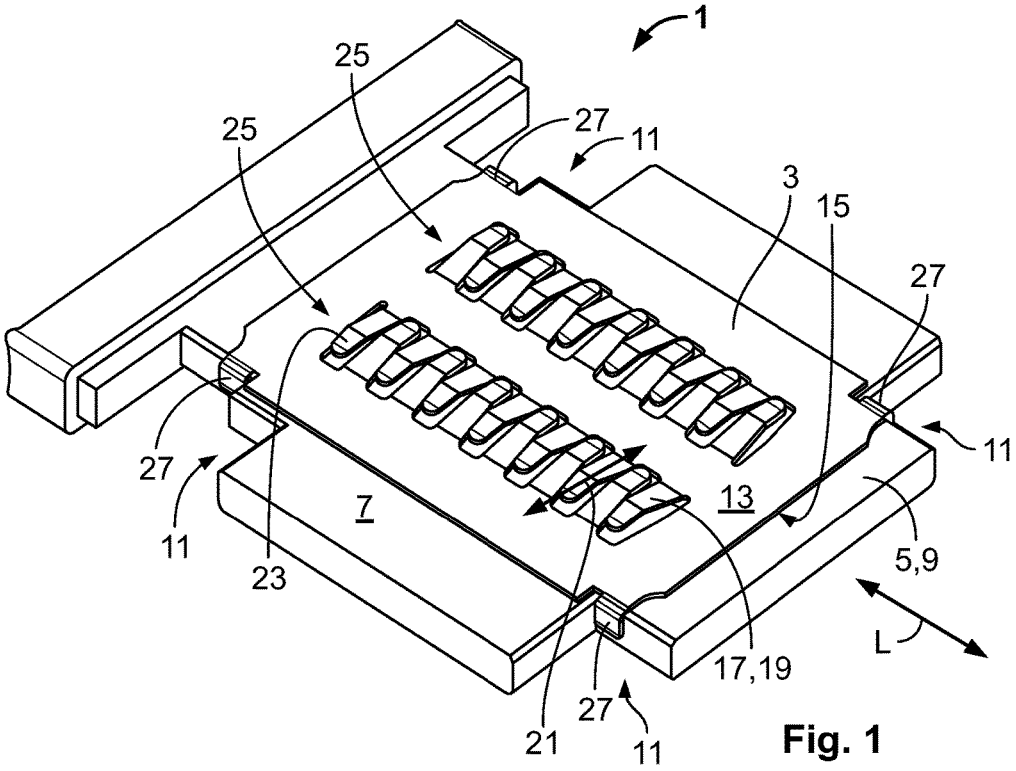
FIG. 1 shows a high current conductor according to the invention with a panel-shaped interface member in a perspective illustration.

In the following, a high current conductor 1 according to the invention, with a panel-shaped interface member 3 according to the invention, is illustrated in FIG. 1. At the same time, reference is made to FIG. 5 which shows the high current conductor 1 according to the invention in a sectional illustration.

The high current conductor 1 has the compacted end 5. The compacted end 5 can be formed by resistance welding, ultrasonic welding, crimping, soldering or by other appropriate techniques. Likewise, the end 5 can also be compacted by combining a number of these techniques. The compacted end 5 has a substantially flat form which spans the conductor plane 7. The compacted end 5 constitutes the contacting section 9 of the high current conductor 1. The contacting section 9 as a compacted end 5 of the high current conductor 1 is only given as an example. The contacting section 9 can also be disposed in a region of the high current conductor 1 which does not constitute an end of the high current conductor 1. The high current conductor 1 is preferably a grounding strap with a compacted end 5 as specified above. Alternatively, the high current conductor 1 can also be a bus bar or some other conductor. In the case of a bus bar, the part of the latter to be contacted can already be sufficiently compact so that additional compacting is not necessarily required. The end 5 of the bus bar is then compacted per se.

The high current conductor 1 has recesses 11 which can serve to receive form closure elements of a holding structure and/or of the interface member 3. The compacted end 5 extends substantially along a conduction direction L. The recesses 11 preferably extend transversely to the conduction direction L parallel to the conductor plane 7 into the compacted end 5. In this way, there can be form closure with the compacted end 5 at least in conduction direction L if one or more form closure elements are disposed in one or more of the recesses 11.

The panel-shaped interface member 3 lies on the contacting section 9 and is connected to the latter, by adhesive bond and/or with form locking. Preferably, the interface member 3 is connected to the high current conductor 1 by laser welding. However, other types of connection are also possible. For example, the interface member 3 can be soldered, riveted, or crimped to the high current conductor 1. Combinations of these types of connection are also possible.

The interface member 3 has a contacting side 13 which, in the state connected to the high current conductor 1, points away from the compacted end 5. The contacting side 13 serves to contact a tab contact. The connection side 15 of the interface member 3 is located facing away from the contacting side 13. In the assembled state, the connection side 15 lies on the compacted end 5 or the contacting section 9.

The interface member 3 has a plurality of contacting elements 17. The contacting elements 17 are in the form of elastically deflectable contact springs 19. They extend away from the contacting side 13 and can be deflected elastically towards the latter. Each of the contact springs 19 has a form which is elongate overall, a longitudinal direction 21 of the contact springs 19 running substantially perpendicular to the conduction direction L. On their free ends 23, the contact springs 19 are at least partially bent back in the direction of the contacting side 13. In this way, the free ends 23 are rounded, by means of which the surface of a tab contact, which is connected to the contacting side 13, can be protected. Preferably, the contact springs 19 are arranged in rows running parallel to the conduction direction L. Here the longitudinal direction 21 of contact springs 19 lying next to one another run parallel to one another. Preferably, contact springs 19 lying next to one another have alignments in opposite directions. This means that their free ends 23 each point in opposite directions. Preferably, the interface member 3 has two rows 25 of contact springs 19 running parallel to the conduction direction L and parallel to one another. In this way even covering of the contacting side 13 with contact springs 19 or with contacting elements 17 can be provided.

The interface member 3 has form closure elements 27 which can serve to position the interface member 3 on the compacted end 5 in order to secure the position during a fastening process, such as for example welding. The form closure elements 27 are preferably disposed on the outer ends of the interface member 3. They extend away from the contacting side 13 and in the state fitted on the high current conductor 1 are disposed in the recesses 11. In this way, displacement of the interface member 3 is effectively prevented both in the conduction direction L and transversely to this within the conductor plane 7.

Figure 2:
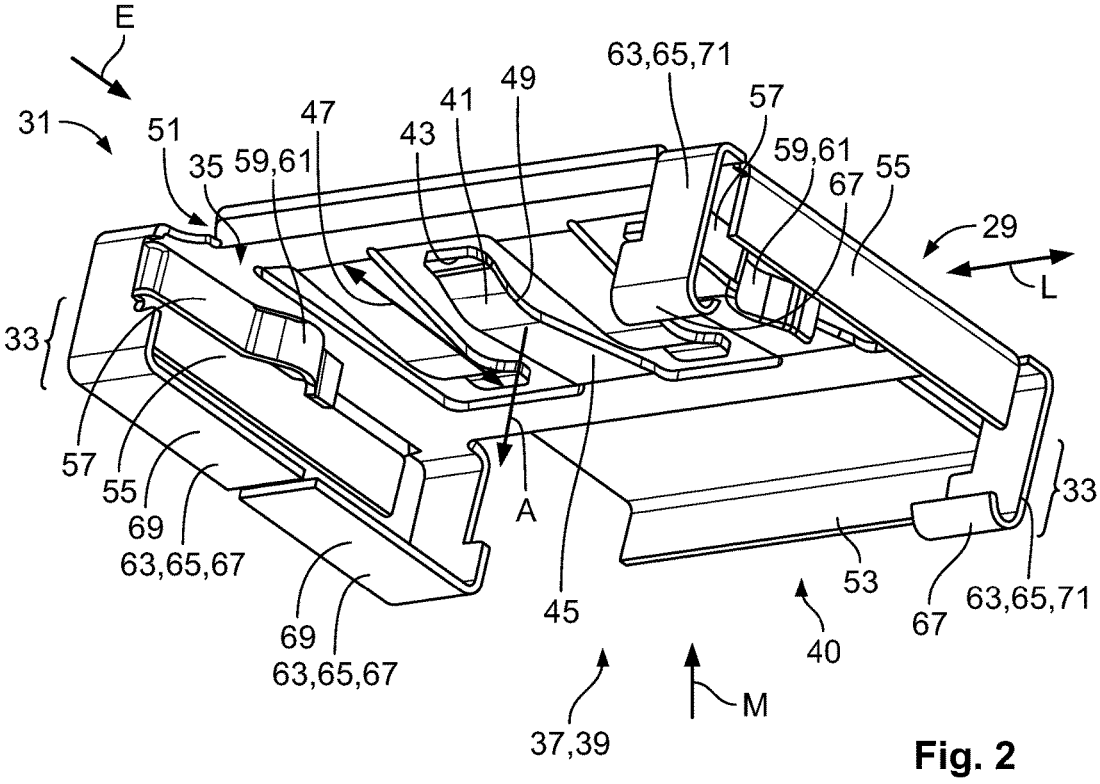
FIG. 2 shows a holding structure according to the invention in a perspective illustration looking into a common cavity.

FIG. 2 shows a holding structure 29 according to the invention in a perspective illustration. The holding structure 29 can constitute an arrangement 31 according to the invention or be part of such an arrangement if the arrangement 31 includes additional components, for example an interface member 3.

The holding structure 29 is preferably formed in one piece from a steel. In this way, the holding structure 29 is particularly solid and resistant.

The holding structure 29 has a connection section 33 for mounting the holding structure 29 to a contacting section 9 of a high current conductor 1 and a receptacle 35 for a tab contact. A receiving space 37 for the contacting section 9 of the high current conductor 1 can be disposed in the connection section 33. This receiving space 37 preferably forms with the receptacle 35 for the tab contact a common cavity 39. In the connection section 33, the holding structure 29 is preferably open on its side lying opposite the receptacle 35. The assembly opening 40 thus formed can facilitate connection to a high current conductor 1.

The holding structure 29 has press-on elements 41 which are designed to generate a contact pressure in the direction of the connection section 33. In this way, a direction of pressing on A is predetermined. If a high current conductor 1 is disposed in the connection section 33, the direction of pressing on A thus points in the direction of the high current conductor 1. As viewed in the direction of pressing on A, the connection section 33 is disposed behind the receptacle 35. In other words, the connection section 33 lies opposite the press-on elements 41 beyond the receptacle 35. In this way, a tab contact disposed in the receptacle 35 can be pressed in the direction of the connection section 33 or onto a high current conductor 1 fixed here.

When made of steel, the press-on elements 41 can benefit from the good spring properties of steel. If made of steel, the press-on elements 41 have a high contact pressure in the direction of the connection section 33. In this way, a tab contact disposed in the receptacle 35 can be pressed with high pressure against the contacting section of the high current conductor. If the holding structure 29, in particular the press-on elements 41, were, in contrast, made of a metallic material which was chosen with regard to electrical conductivity, there would be a risk of the press-on elements being plastically deformed over time. Materials with a high percentage of copper, for example, tend to creep over time, due to which the contact pressure dwindles. There is also a risk that with frequent deflection of the press-on elements 41, for example due to repeatedly introducing a tab contact into the receptacle 35, the press-on elements will lose their solidity. In the holding structure 29 according to the invention, the electrical connection of a tab contact disposed in the receptacle 35 to the high current conductor is essentially established by the direct contact with the contacting section of the high current conductor or with an interface member disposed on the contacting section. The holding structure 29 can be formed from other materials that have the requisite spring properties.

The press-on elements 41 are formed monolithically with the holding structure 29 and can be deflected elastically away from the receptacle 35, (i.e., they can be deflected away from the receptacle 35 in the direction opposite the direction of pressing on A). At least is there is no tab contact disposed in the receptacle 35 the press-on elements 41 project at least partially into the receptacle 35. The press-on elements 41 have an overall elongate form and run substantially transversely to the direction of pressing on A.

The press-on elements 41 are preferably made in the form of spring arms, one free end 43 being deflectable and one base 45 being connected to the rest of the holding structure 29. Preferably, a plurality of press-on elements 41 are disposed next to one another, the free ends 43 and the bases 45 of adjacent press-on elements 41, respectively, alternating. The press-on elements 41, therefore, have an alternating alignment.

The longitudinal directions 47 of adjacent press-on elements 41, which are predetermined by a connection line of one respective base 45 to a free end 43, preferably run parallel to one another. The press-on elements 41 have curved regions 49 which are orientated with their convex sides towards the receptacle 35. In this way, abrasive wear of a surface of a tab contact, upon insertion into the receptacle 35, can be avoided.

The holding structure 29 has an insertion opening 51 which clears the receptacle 35 for a tab contact. Preferably, the receptacle 35 or the holding structure 29 has precisely one insertion opening 51 in order to predetermine a defined insertion direction E for a tab contact. The press-on elements 41 preferably run with their longitudinal directions 47 parallel to the insertion direction E.

On their end lying opposite the insertion opening 51, the holding structure can have a stop element 53 which can prevent a tab contact from being pushed through beyond a desired position in the receptacle 35. Furthermore, the stop element 53 can prevent a tab contact from being introduced into the holding structure 29 in a direction other than the insertion direction E.

Preferably, the holding structure 29 is shaped so that the direction of pressing on A and the insertion direction E run transversely to one another. It is also preferable if the direction of pressing in E and the direction of pressing on A run transversely to the conduction direction L of a high current conductor 1. As viewed in the conduction direct L, the holding structure preferably, respectively, has another stop element 55 on both of the opposing ends. These stop elements 55 can also serve to prevent the introduction of a tab contact in a direction deviating from the insertion direction E. The stop elements 53 and 55 can additionally or alternatively also serve as spacers or as supports for the holding structure 29 on the contacting section 9. Therefore, with the stop elements 53 and 55 the holding structure 29 can be supported by the high current conductor 1 in the direction of pressing on A.

The holding structure 29 has clamping elements 57 which flank the receptacle 35 parallel to the insertion direction E. The clamping elements 57 project into the receptacle 35 and can be deflected elastically out of the latter. The clamping elements 57 are made in the form of spring arms and run substantially parallel to the insertion direction E. Here the clamping elements 57 can be deflected parallel to the conduction direction L or transversely to the insertion direction E and transversely to the direction of pressing on A. The clamping elements 57 can serve to hold a tab contact disposed in the receptacle 35 by frictional bond.

In order to hold a tab contact in the receptacle 35 more securely in the insertion direction E, the clamping elements 57 have on free, deflectable ends 59 latching elements 61 which can engage in complementary recesses in a tab contact in order to additionally secure the latter in the insertion direction E. The clamping elements 57 with the latching elements 61 then constitute form limits for the tab contact. In addition to securing a tab contact disposed in the receptacle 35, the clamping elements 57 can also serve to guide a tab contact during introduction into the receptacle 35.

In the connection section 33, the holding structure 29 has mounting arms 63 which serve to fix the holding structure 29 to the contacting section 9 of the high current conductor 1. The mounting arms 63 are preferably made in the form of form closure elements 65. The form closure elements 65 are designed to engage behind the contacting section 9 of the high current conductor 1. For this purpose, they initially run parallel to the direction of pressing on A and then have sections 67 which run transversely to the direction of pressing on A. Two respective sections 67, which lie opposite one another in the insertion direction E, point towards one another here. The connection section 33 is delimited in the direction of pressing on A by the sections 67. In a state fitted on the high current conductor 1, the high current conductor 1 or its contacting section 9 can rest against the sections 67. If a tab contact is now pressed against a high current conductor disposed in the connection section 33 by the press-on elements 41, the form closure elements 65 serve as counter-bearings for the high current conductor 1. Therefore, the high current conductor 1 is supported against the form closure elements 65 and cannot be moved out of the holding structure 29 by the contact pressure. In this way, a tab contact can be pressed with high pressure against the contacting section 9.

According to a preferred embodiment, the holding structure 29 has two stationary form closure elements 69 and two form closure elements 65 which are in the form of elastically deflectable latching means 71. The two stationary form closure elements 69 lie parallel to the insertion direction E here and the two form closure elements 65 made in the form of latching means 71 also lie parallel to the insertion direction E.

The latching means 71 can be deflected away from the connection section 33 transversely to the direction of pressing on A. Preferably, the latching means 71 can be deflected away from the connection section 33 parallel to the insertion direction E. By means of the elastic deflectability, the sections 67 of the latching means 71 can be deflected away from the connection section 33, so that a high current conductor 1 can be inserted into the connection section 33. In order to insert a high current conductor 1 or in order to place the holding structure 29 on a high current conductor 1, a part of the high current conductor 1 can initially be inserted through the assembly opening 40 into the connection section 33, the fixed form closure elements 69 engaging behind the latter. Then the part of the holding structure 29 which has the latching means 71 can be pressed against the high current conductor 1, so that the latching means 71 are deflected. In this way, the high current conductor 1 can be moved into the connection section 33 and the latching means 71 can return to their initial position shown in FIG. 2. All of the form closure elements 65 of the holding structure 29 then engage behind the high current conductor 1. The high current conductor 1 can, therefore, be moved along an assembly direction M into the holding structure 29 which runs in the direction opposite the direction of pressing on A.

Figure 3:
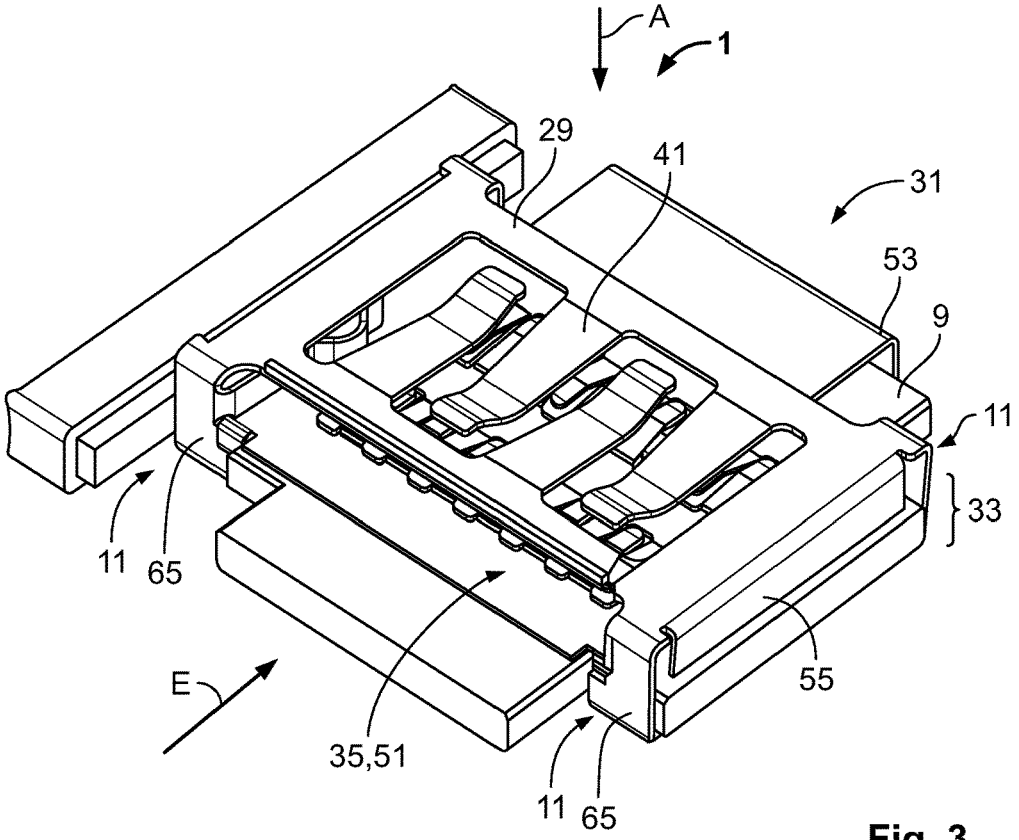
FIG. 3 shows the holding structure of FIG. 2 in an assembled state on the high current conductor of FIG. 1.

FIG. 3 shows a holding structure 29 fitted on a contacting section 9 of a high current conductor 1. Here the high current conductor 1 corresponds to the embodiment described with reference to FIG. 1 and the holding structure 29 corresponds to the embodiment described with reference to FIG. 2. In this case, the panel-shaped interface member 3 and the holding structure 29 are included in the embodiment of the arrangement 31 according to the invention. The holding structure 29 can, in particular, have been connected to the contacting section 9 in the way described with reference to FIG. 2.

In the assembled state, the contacting section 9 is disposed in the connection section 33 of the holding structure 29. The form closure elements 65 of the holding structure 29 engage behind the latter. The form closure elements 65 are disposed here in the recesses 11 of the contacting section 9. In this way, the holding structure 29 is prevented from becoming detached.

The press-on elements 41 of the holding structure are disposed lying opposite the contacting elements 17 of the panel-shaped interface member 3 in the direction of pressing on A. The stop elements 53 and 55 rest against the high current conductor 1, so that the holding structure 29 is supported on the high current conductor 1 in the direction of pressing on A. At the same time, as described above, these serve to prevent a tab contact from being introduced along a direction other than the insertion direction E. The receptacle 35 for a tab contact is now exclusively accessible through the insertion opening 51.

Figure 4:
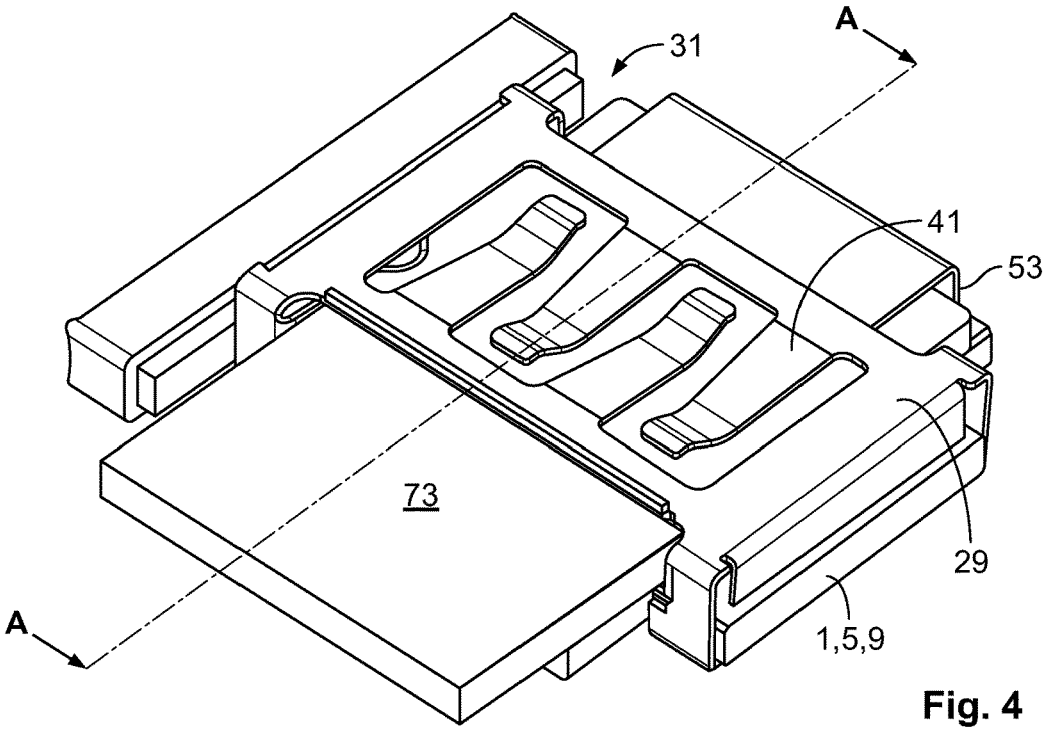
FIG. 4 shows the arrangement of FIG. 3 with an inserted tab contact.
Figure 5:
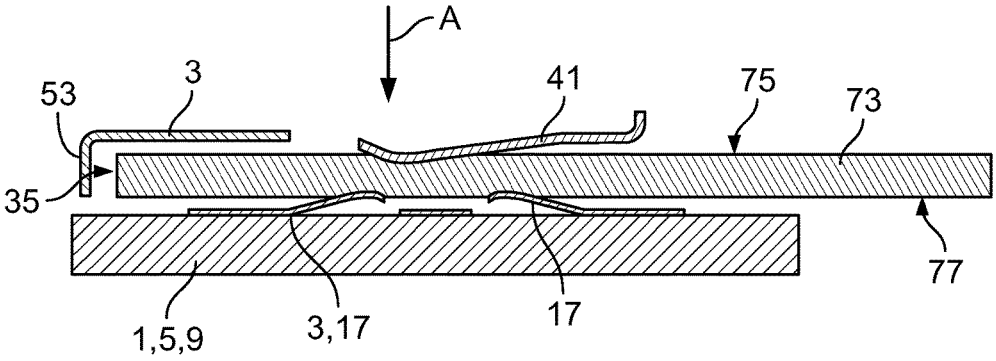
FIG. 5 shows the arrangement from FIG. 4 in a cross-sectional illustration.

FIG. 4 shows an arrangement 31 according to the invention as shown in FIG. 3, but with indication of an inserted tab contact 73. FIG. 5 shows a cross-section along the section line marked as A-A in FIG. 4.

The tab contact 73 is disposed in the receptacle 35. Here the press-on elements 41 lie on its upper side 75 and the contacting elements 17 lie on its lower side 77. The press-on elements 41 generate a contact pressure in the direction of the connection section 33 by means of which the tab contact 73 is pressed against the panel-shaped interface member 3 in the direction of pressing on A. In this way, an electrical contact is established between the tab contact and the high current conductor 1 via the contacting elements 17 or via the interface member 3. It should be noted that the arrangement 31, according to the invention, may also consist purely of the holding structure 29. The panel-shaped interface member 3 constitutes an improvement of the arrangement 31 according to the invention, but is not necessarily required.

Figure 6:
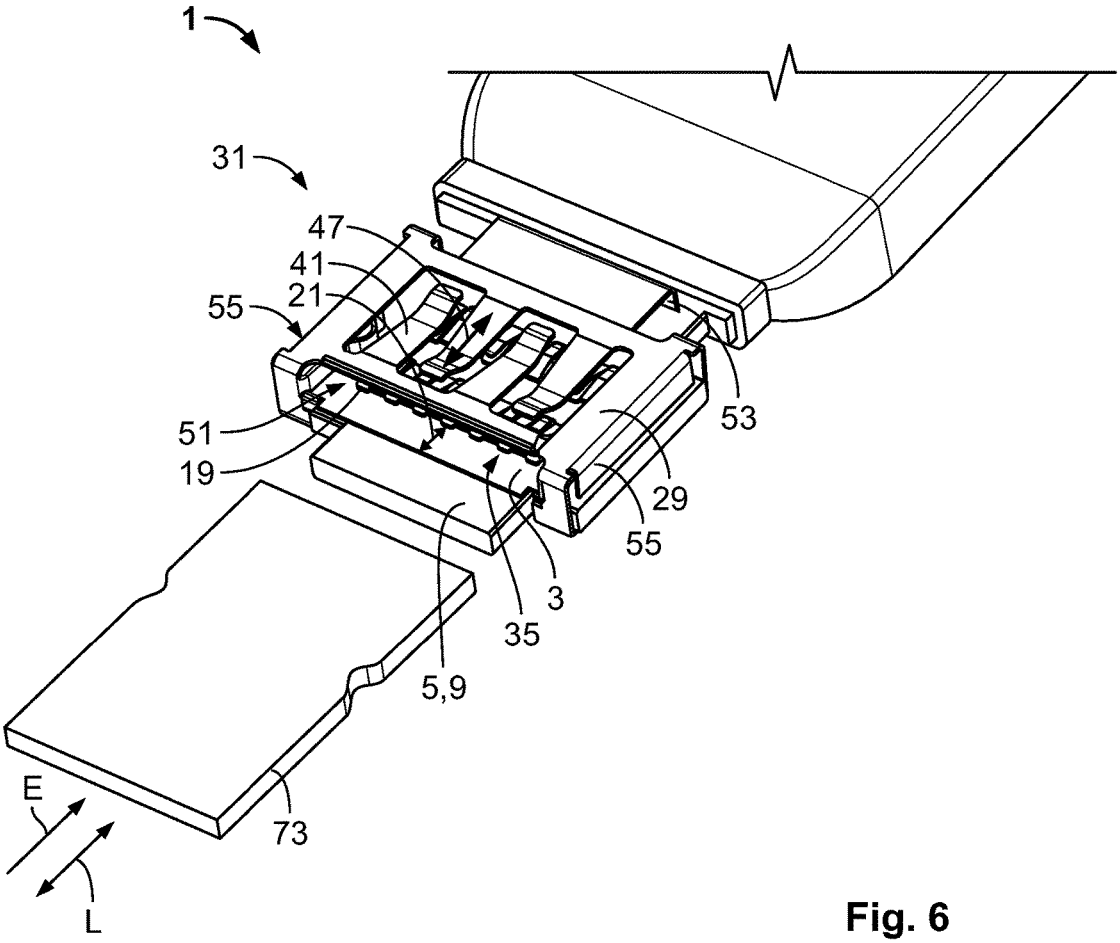
FIG. 6 shows a second embodiment of an arrangement according to the invention.

In the following, a second embodiment of the arrangement 31, according to the invention, with a holding structure 29, according to the invention, on a high current conductor 1 is described with reference to FIG. 6. For the sake of brevity, one will only discuss the differences in comparison to the embodiment described with reference to FIGS. 1-5.

While in the first embodiment the insertion direction E runs transversely to the conduction direction L, so that this is a 90° plug connection, the insertion direction E and the conduction direction L in the second embodiment run parallel to one another. The embodiment illustrated in FIG. 5, therefore, constitutes a 180° plug connection.

The holding structure 29 has an insertion opening 51 which opens the receptacle 35 in the conduction direction L or in the direction opposite the insertion direction E. Towards the high current conductor 1, the holding structure has a stop element 53. On both of the ends lying transversely to the conduction direction L, the holding structure 29 has two further stop elements 55 lying opposite one another.

The press-on elements 41 are arranged with their longitudinal directions 47 parallel to the insertion direction E, so as to also enable trouble-free introduction of a tab contact 73 in the second embodiment. The longitudinal directions 21 of the contact springs 19 of the panel-shaped interface member 3 are also aligned parallel to the insertion direction E.

What is claimed is:

1. A holding structure for an arrangement for establishing an electrical connection between a tab contact and a high current conductor, the holding structure comprising:

a connection section with at least one mounting arm for mounting to a contacting section of a high current conductor;

a receptacle for a tab contact; and at least one press-on element configured to generate a contact pressure on the tab contact in the direction of the high current conductor in the connection section, the at least one press-on element is formed monolithically with the holding structure and can be deflected elastically away from the receptacle, the connection section lies opposite the at least one press-on element beyond the receptacle for the tab contact.

2. A holding structure for an arrangement for establishing an electrical connection between a tab contact and a high current conductor, the holding structure comprising:

a connection section with at least one mounting arm for mounting to a contacting section of a high current conductor;

a receptacle for a tab contact, the tab contact has a lower side positioned adjacent the high current conductor in the holding structure and an opposite upper side positioned further from the high current conductor than the lower side; and at least one press-on element configured to generate a contact pressure on the tab contact in the direction of the high current conductor in the connection section, the at least one press-on element abuts and generates the contact pressure on the upper side of the tab contact.

3. The holding structure according to claim 2, wherein the at least one press-on element is not disposed in an electrical path between the tab contact and the high current conductor.

4. The holding structure according to claim 1, wherein the connection section has at least one form closure element for engaging behind a contacting section of a high current conductor.

5. The holding structure according to claim 4 wherein the at least one form closure element is in the form of a latching means that is deflectable away from the connection section.

6. The holding structure according to claim 5, wherein the holding structure is lockable to the contacting section of the high current conductor along an assembly direction running substantially parallel to a direction of pressing on the at least one press-on element.

7. The holding structure according to claim 6, wherein the connection section has a receiving space for the contacting section of the high current conductor the receiving space communicating with the receptacle for the tab contact.

8. The holding structure according to claim 7, wherein the holding structure is at least partially open in the connection section on its side opposite the at least one press-on element.

9. The holding structure according to claim 8, further including at least one clamping element projecting at least partially into the receptacle and deflectable elastically out of the receptacle perpendicular to a direction of pressing on the press-on element the at least one clamping element frictionally engaging the tab contact.

10. The holding structure according to claim 9, wherein the holding structure is formed in one piece from steel.

11. An arrangement for establishing an electrical connection between a tab contact and a high current source, the arrangement comprising:

a holding structure including:

(a) a connection section with at least one mounting arm for mounting to a contacting section of a high current conductor;

(b) a receptacle for a tab contact, and (c) at least one press-on element configured to generate a contact pressure on the tab contact in the direction of the high current conductor in the connection section; and at least one panel-shaped interface member having a connection side secured to a contacting section of a high current conductor and a contacting side extending into the receptacle of the holding structure for contacting the tab contact.

12. The arrangement according to claim 11, wherein the contacting side of the at least one panel-shaped interface member has at least one contacting element extending at least partially away from the at least one panel-shaped interface member.

13. The arrangement according to claim 12, wherein the at least one contacting element of the contacting side of the at least one panel-shaped interface member is made in the form of a contact spring that is deflectable elastically towards the rest of the at least one panel-shaped interface member.

14. A high current conductor, comprising:

at least one compacted end; and a panel-shaped interface member:

(a) having a contacting side pointing away from the compacted end with a plurality of contacting elements each extending at least partially away from the interface member, the plurality of contacting elements are arranged next to one another transversely to their longitudinal directions and parallel to one another with their longitudinal directions, and adjacent contacting elements are connected securely to opposite sides of the panel-shaped interface member, and (b) connected, at least by one of frictional and adhesive bond, to the at least one compacted end.

15. The arrangement of claim 11 further including a high current conductor.

16. A holding structure for an arrangement for establishing an electrical connection between a tab contact and a high current conductor, the holding structure comprising:

a connection section with at least one mounting arm for mounting to a contacting section of a high current conductor;

a receptacle for a tab contact; and a plurality of press-on elements configured to generate a contact pressure in the direction of the connection section, the plurality of press-on elements are arranged next to one another transversely to their longitudinal directions and parallel to one another with their longitudinal directions and adjacent press-on elements are connected securely to the holding structure in the opposite direction.

17. The arrangement according to claim 11, wherein the tab contact is disposed between the at least one press-on element and the contacting side of the at least one panel-shaped interface member.

18. The holding structure according to claim 16, wherein the holding structure has at least one form closure element for engaging a contacting section of a high current conductor.

19. The holding structure according to claim 1, wherein the tab contact has a lower side positioned adjacent the high current conductor in the holding structure and an opposite upper side positioned further from the high current conductor than the lower side, the at least one press-on element abuts and generates the contact pressure on the upper side of the tab contact.

20. The holding structure according to claim 19, wherein the at least one press-on element is not disposed in an electrical path between the tab contact and the high current conductor.

* * * * *